US005970574A

United States Patent [19]

Thrash, Jr.

[11] Patent Number: 5,970,574

[45] Date of Patent: Oct. 26, 1999

[54] APPARATUS AND METHOD FOR CLEANING SURFACES BY REMOVING AND CONTAINING WASTE

[75] Inventor: Thomas B. Thrash, Jr., Houston, Tex.

[73] Assignee: HydroChem Industrial Services, Inc., Deer Park, Tex.

[21] Appl. No.: 08/840,016

[22] Filed: Apr. 24, 1997

[51] Int. Cl.[6] ..... A47L 11/30

[52] U.S. Cl. ..... 15/321; 15/322; 15/345; 15/421

[58] Field of Search ..... 15/321, 322, 345, 15/421

[56] References Cited

U.S. PATENT DOCUMENTS

| | | | |
|---|---|---|---|
| 4,107,816 | 8/1978 | Matthews | 15/322 X |
| 4,191,589 | 3/1980 | Halls et al. | 15/322 X |
| 4,377,018 | 3/1983 | Cain | 15/345 X |
| 5,210,996 | 5/1993 | Fassauer | 15/345 X |
| 5,826,298 | 10/1998 | Rohrbacher et al. | 15/322 X |

*Primary Examiner*—Chris K. Moore

*Attorney, Agent, or Firm*—Browning Bushman

[57] ABSTRACT

The present invention is directed to methods and apparatus for cleaning industrial and commercial operations hard surfaces, e.g., concrete and asphalt slabs, walls, tanks, grates, and ship hulls, contaminated by oil and chemical spills or barnacles. The methods and apparatus of the present invention produce a high velocity airflow about only the periphery of the area being cleaned by the device to provide improved entrainment and removal of cleaning fluid and dislodged debris. High velocity streams of cleaning fluid are directed against the surface from nozzles disposed on rotating arms of a hub suspended within the portable housing of the slab cleaner. The spent cleaning fluid and dislodged debris are removed by the application of a vacuum to a chamber extending about the periphery of the housing to create the high velocity airflow. Thus, high velocity airflow is developed without fear that the slab cleaner will be sucked down and become temporarily stuck on the surface being cleaned. Control of the airflow through the central housing also may be achieved through adjustment of an air vent therein, together with the action of a flexible skirt or seal about the exterior of the peripheral chamber.

12 Claims, 3 Drawing Sheets

FIG. 3
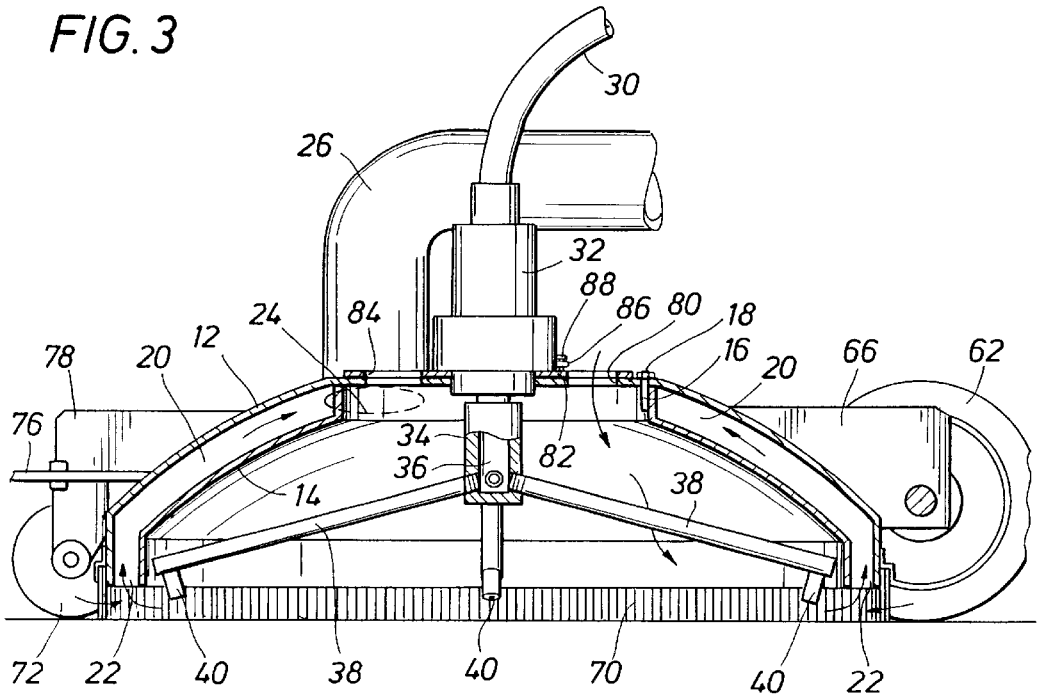
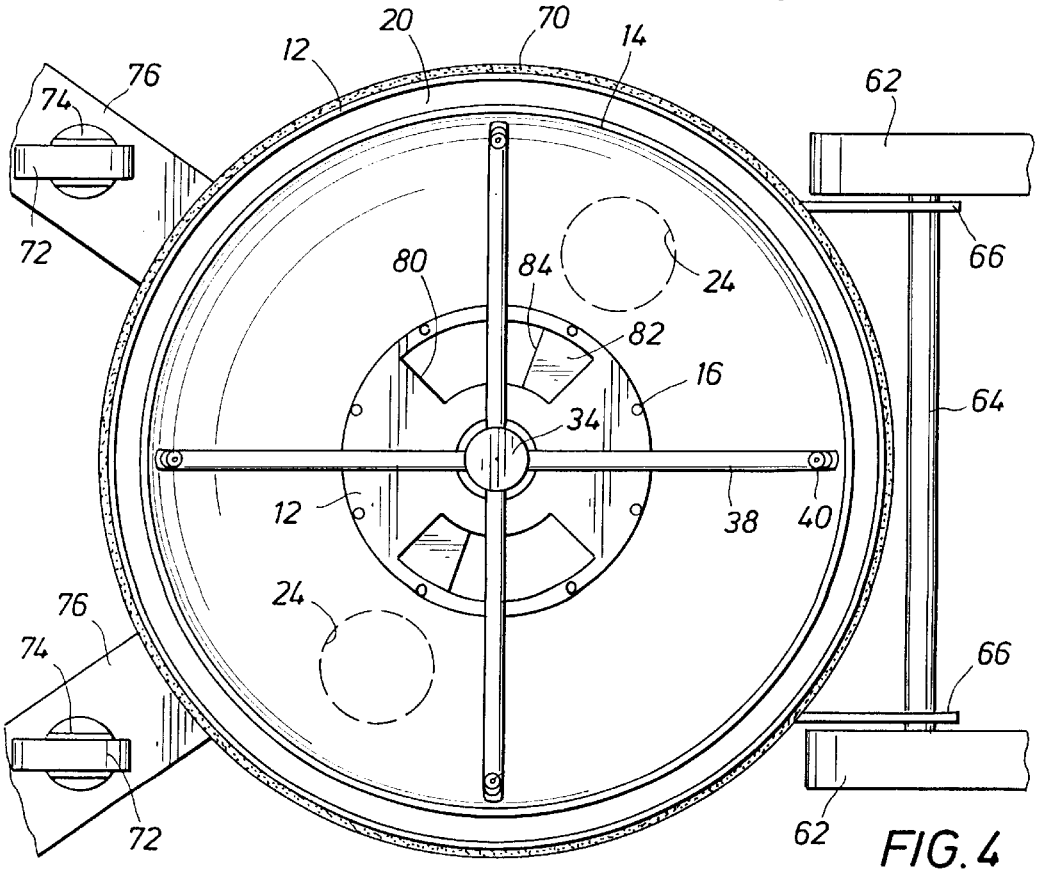
FIG. 4

APPARATUS AND METHOD FOR CLEANING SURFACES BY REMOVING AND CONTAINING WASTE

BACKGROUND OF THE INVENTION

1. Field of the Invention

The present invention generally relates to methods and apparatus for containing and controlling waste during the cleaning of surfaces. The methods and apparatus of the present invention are particularly useful for cleaning industrial and commercial surfaces, e.g., concrete and asphalt slabs and steel surfaces such as tanks and ship hulls, which have become contaminated with oil, grease and other chemicals. More specifically, the present invention is directed to methods and apparatus which employ a unique application of a vacuum to the surface being cleaned to allow complete control of dislodged contaminants, e.g., heavy metals, radioactive materials, PCBs (polychlorinated biphenyls) and other hazardous chemicals.

2. Description of the Background

The requirement for maintaining clean work areas in industrial and commercial environments is not only necessary for the maintenance of a healthy workplace but is also important in order to prevent contamination of the environment with trace chemicals dislodged in the cleaning process. As environmental standards are strengthened, the necessity for efficiently removing debris and contamination, including oil, grease, chemicals and the like, from hard surfaces in industrial and commercial settings is increasing. Once removed from the surface, it is also necessary to contain and transport the contaminants to an appropriate treatment facility.

Many commercially used cleaning processes employ vacuum and high velocity water streams to dislodge and remove contaminants. The contaminants are typically collected with the cleaning water in a vacuum truck for temporary storage and transport to a waste treatment facility. However, those processes are so inefficient due to inadequate containment and leakage that some of the dislodged material, including hazardous contaminants, are scattered to surrounding areas by the high velocity water streams. These scattered contaminants cause contamination of previously safe areas.

A common form of manually operated cleaning device for cleaning hard surfaces has come to be known in the industry as a slab cleaner. A typical slab cleaner has the general appearance of a lawnmower. However, a rotating arm for delivery of a high pressure water spray has been substituted for the cutting blade. Many attempts have been made to connect a vacuum source to such a device to direct air over the surface in order to entrain and remove water and dislodged contaminants. In the typical prior art device, a vacuum source was connected through the single wall housing of the slab cleaner. In order to maintain adequate airflow within the housing, a flexible skirt or lip was disposed about the periphery of the housing extending downward to the surface to be cleaned. Air could flow under this skirt and into the housing.

While the foregoing arrangement was typical of most prior art slab cleaning devices, it suffered from many deficiencies. In general, there was little or no means for controlling the airflow within the housing and across the surface being cleaned. Because the vacuum acted on the total surface area covered by the housing, these prior art devices had a tendency, in some circumstances, to suck down on the surface with so much force that it was impossible to maneuver the device across the surface. In those circumstances, the cleaning operation had to be stopped and the vacuum released before cleaning could resume. If, however, the gap around the periphery of the housing was increased to prevent vacuum suck down, the additional space could allow escape of the high pressure water stream and dislodged contaminants. Airflow around the perimeter was controlled by the size of the gap between the housing and surface being cleaned. Therefore, elevation changes around the perimeter and surface deformities, e.g., expansion joints and uneven surfaces, changed the airflow path and made these prior devices sensitive, unreliable and inconsistent. At the extreme, failure to maintain an adequate seal between the periphery of the housing and the surface being cleaned resulted in inadequate airflow through the housing. In those cases, the cleaning fluid and dislodged debris was not contained under the housing or picked up and removed by the slab cleaner.

Another problem often suffered by those prior devices was ponding of the water on the work surface under the housing. Ponding occurred when the air movement through the housing was insufficient and not directed properly to draw off the cleaning water at the same rate it was being delivered by the spray arm. Water would build up under the housing. Because all of the air being withdrawn from these prior art devices was drawn from under the skirt about the periphery of the housing, a barrier of water up to an inch or more in depth could accumulate on the surface under the housing. Ponding impeded good operation of the device by creating a barrier between the high pressure water stream and the surface to be cleaned. Thus, a portion of the energy of the water stream was dissipated in the standing water, providing little or no cleaning benefit and introducing more turbulence and splashing, making containment more difficult. Further, when operated on uneven surfaces or over the expansion joints of concrete or asphalt slabs, the seal around the perimeter was totally lost, and ponded water and debris was forcefully propelled onto the surrounding surfaces.

The industrial and commercial cleaning industry would benefit greatly from improved slab cleaning apparatus and methods which could overcome the shortcomings discussed above. There has been a long felt but unfulfilled need in the industry for such improved methods and apparatus. The present invention solves that need by correcting the problems described above. The present invention offers a safe method for the precise and controlled removal of hazardous materials as well as other contaminants from industrial and commercial surfaces.

SUMMARY OF THE INVENTION

The present invention is directed to apparatus and methods for cleaning surfaces and particularly to apparatus and methods for better controlling the airflow across those surfaces to entrain and remove cleaning fluid and dislodged debris. A slab cleaner in accord with the present invention comprises a housing having an opening on one side for positioning adjacent a hard surface, a fluid distribution system mounted in the housing for receiving a cleaning fluid under high pressure and directing the fluid against the hard surface at a high velocity and a chamber disposed about the periphery of the housing and adjacent the opening through which a vacuum may be applied to create a high velocity airflow to entrain and remove cleaning fluid and dislodged contaminants from the hard surface.

A slab cleaner in accord with the present invention produces better cleaning of the hard surface and containment of the dislodged contaminants. These improvements are achieved by providing improved control of the airflow through the housing to produce a consistent and uniform high velocity airflow about the periphery of the housing to remove the cleaning fluid and dislodged contaminants from the hard surface.

In a preferred embodiment of the present invention the housing is generally dome-shaped and includes a rotary joint for communication with a high pressure fluid source. Within the housing and in fluid communication with the rotary joint is a rotatable hub from which a plurality of symmetrically disposed arms extend. On each arm is at least one nozzle to direct a cleaning fluid towards the hard surface. The nozzles are preferably positioned at an angle with respect to both the hard surface and the plane in which they rotate to impart rotary motion to the arms as the high pressure fluid exits the nozzles and is directed toward the hard surface. The nozzles are preferably canted slightly inward to direct the flow of high velocity cleaning fluid toward the center of the opening and away from the periphery of the housing. Rotation of the arms directs a high velocity stream of cleaning fluid into contact with the hard surface to dislodge contaminants therefrom. As the device is moved across the surface to be cleaned, all areas of the surface will be impacted by the high velocity fluid streams exiting the nozzles.

A more preferred embodiment of the slab cleaner of the present invention further includes a chamber formed about the periphery of the housing through which a reduced pressure, preferably a vacuum, is applied to create a high velocity airflow above the hard surface about the periphery of the housing to withdraw spent cleaning fluid and dislodged debris. By minimizing the size of this chamber and the cross-sectional area of the port adjacent to the hard surface, the velocity of the airflow above the small surface area below the peripheral chamber will be uniform and greater than the velocity achieved in prior art devices which applied the vacuum to the entire housing. Thus, the slab cleaner of the present invention will more efficiently and completely entrain and remove cleaning fluid and dislodged contaminants while minimizing the possibility that the device will suck down onto the hard surface and become stuck as did prior art devices. Further, by increasing the airflow about the perimeter of the housing, ponding of cleaning fluid is minimized and perimeter sealing is less critical. In the presently most preferred embodiment, this chamber is formed between the walls of a double walled housing and the vacuum is applied to the chamber.

In another aspect of the present invention, airflow across the surface within the central housing may be controlled by adjustment of an air vent therein. By properly adjusting this vent, air movement in the central cleaning chamber may be controlled to eliminate ponding and further reduce the tendency of the slab cleaner of the present invention to suck down onto the surface being cleaned and become stuck thereon.

Thus, the long felt but unfulfilled need for improved slab cleaning methods and apparatus has been met. The improved methods and apparatus of the present invention provide means for controlling the airflow across the surface by restricting the vacuum applied to a small area about the periphery of the cleaning chamber to remove spent cleaning fluid and dislodged contaminants. These methods and apparatus improve debris removal, minimize loss of cleaning fluid and debris, minimize ponding and improve the overall efficiency of the slab cleaner. These and other meritorious features and advantages of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings, wherein:

FIG. 3 is a cross-sectional view through line 3—3 of FIG. 2 of a slab cleaning device in accord with the present invention;

FIG. 4 is a bottom elevational view of a slab cleaning device in accord with the present invention.

Figure 1:
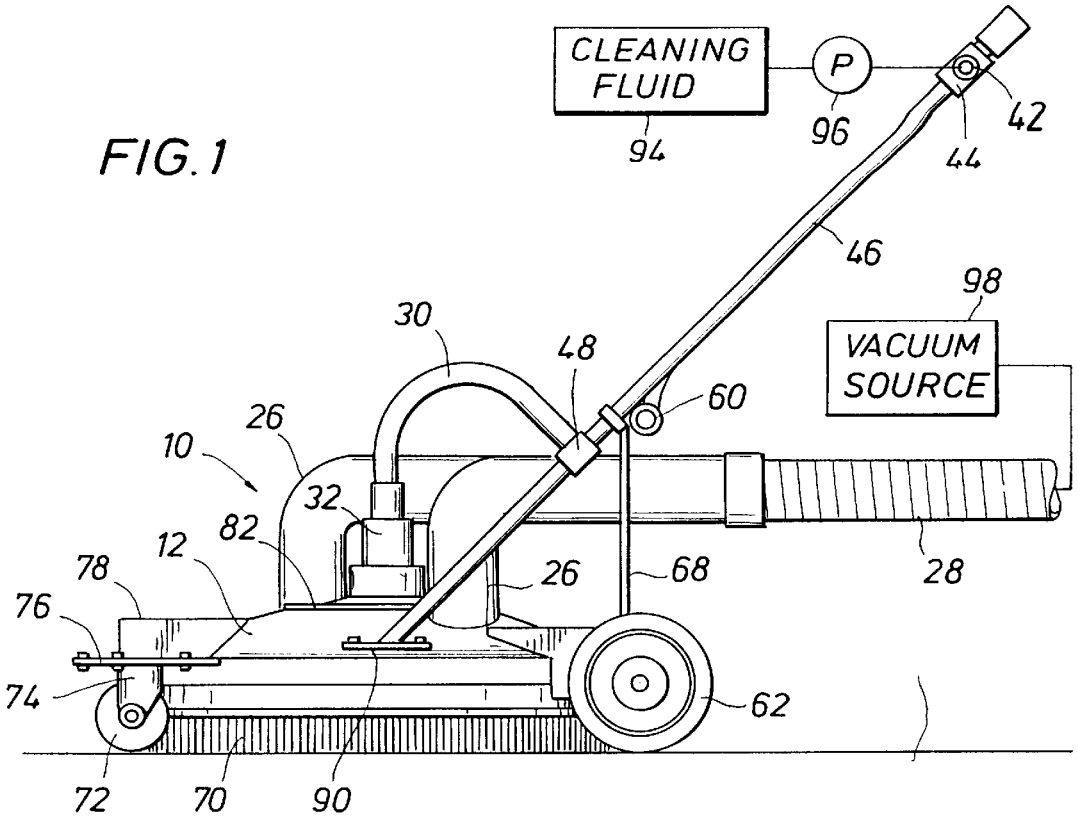
FIG. 1 is a side elevational view of a slab cleaning device in accord with the present invention.
Figure 2:
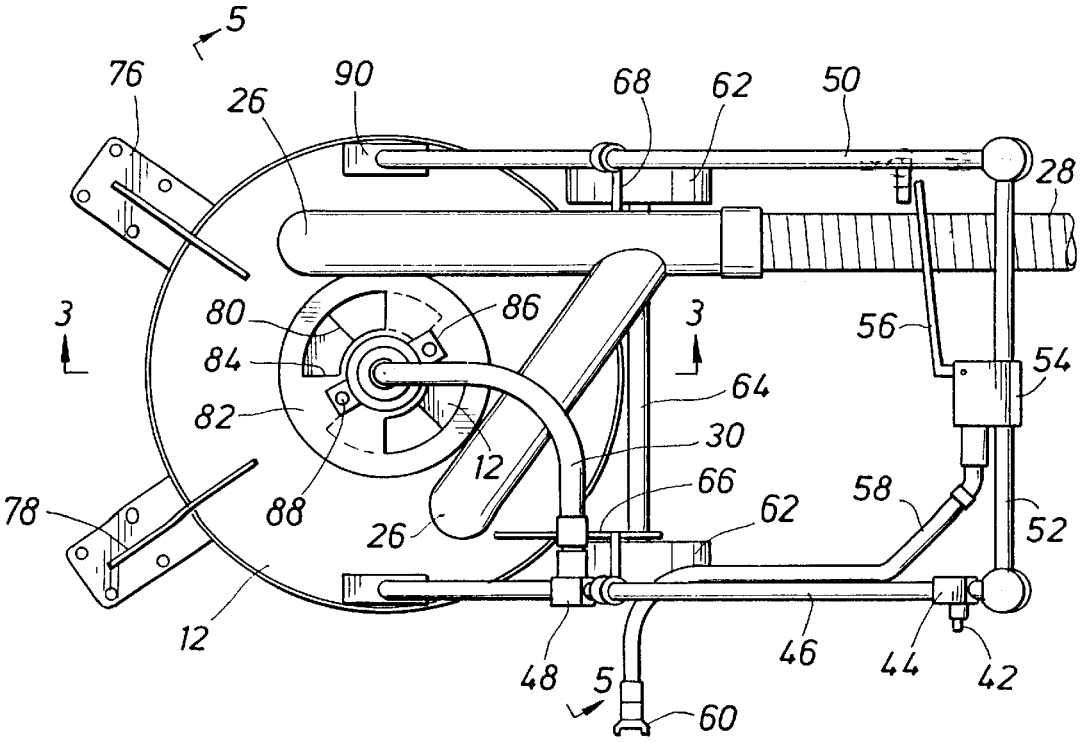
FIG. 2 is a top plan view of a slab cleaning device in accord with the present invention.

While the invention will be described in connection with the presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENT

The present invention provides an apparatus and methods for cleaning surfaces and particularly for better controlling the high velocity airflow applied to those surfaces to entrain and remove spent cleaning fluid and dislodged debris. The improved results achieved using the apparatus and methods of the present invention are obtained by applying a vacuum only to a relatively small area about the periphery of the housing above the surface being cleaned to entrain and remove cleaning fluid and dislodged debris from the surface. Accordingly, a higher velocity is developed across this smaller surface area without increasing the tendency of the slab cleaning device to suck down and become stuck on the surface being cleaned.

A slab cleaner 10 in accord with the present invention is illustrated in FIGS. 1–5. In general, the slab cleaner 10 of the present invention is similar in appearance to a rotary powered lawnmower. In the preferred embodiment, slab cleaner 10 includes a double-walled housing. Within outer housing 12 is disposed inner housing 14 which provides the shield to define the opening for positioning adjacent a hard surface 100 to be cleaned. In the illustrated embodiment, inner housing 14 is generally concentric with but not coextensive with outer housing 12. Inner housing 14 does not extend upwardly to the top centermost portion of outer housing 12. Welded to the upper portion of inner housing 14 are a plurality of bolts 16 extending upwardly for cooperation with holes in outer housing 12. With bolts 16 extending through the holes in outer housing 12, nuts 18 are employed to securely fasten inner housing 14 to outer housing 12. Formed between the inner and outer housings is peripheral chamber 20 through which a vacuum may be applied to a small area of hard surface 100 about the periphery of inner housing 14.

Slab cleaner 10 includes means for delivering any conventional cleaning fluid at a high velocity against surface 100 in the area to be cleaned under inner housing 14. In the preferred embodiment illustrated in FIG. 3, the cleaning fluid is delivered through line 30 to a rotary joint 32 bolted to the top of housing 12. Rotary joint 32 passes through housing 12. Disposed on the underside of rotary joint 32 is rotatable hub 34 having fluid passageway 36 therein. Connected into a plurality of bores in hub 34 and in fluid communication with passageway 36 are a plurality of distribution arms 38. Arms 38 may be connected to hub 34 by any conventional method, e.g., arms 38 may be welded or threaded to hub 34. While a single arm 38 would be sufficient, a plurality of symmetrically disposed arms 38 provide better balance and more uniform and consistent operation. Distribution arms 38 are preferably comprised of hollow tubes plugged at the ends thereof distal to hub 34. Alternatively, arms 38 may be comprised of hollow tubing bent to provide the desired direction of fluid flow against the hard surface.

Disposed near the distal end of each of arms 38 is at least one nozzle 40 for directing the flow of exiting fluid onto hard surface 100. Additional nozzles 40 may be disposed along the length of arms 38. In the preferred embodiment, the nozzles direct the cleaning fluid against surface 100 at an angle which is neither normal to the surface nor in the plane of rotation of nozzles 40. By disposing nozzles 40 at an angle so that the exiting fluid does not strike the surface perpendicularly, rotary motion will be imparted to arms 38 and hub 34 by the reactionary force of the exiting fluid. Such an arrangement eliminates the need for a motor or other means to rotate fluid distribution arms 38, and is, therefore, preferred. However, for some applications, it may be desirable to include a separate power source, e.g., an air or electric motor, to independently rotate arms 38. When using an independent motor to rotate arms 38, nozzles 40 may be positioned to direct the exiting fluid perpendicularly against surface 100. Nozzles 40 may be of any conventional type connected to a plurality of bores disposed near the end and, optionally, along the length of arms 38. Alternatively, nozzles 40 may simply be comprised of holes drilled in arms 38 and disposed at the appropriate angle.

While the cleaning fluid often merely comprises water, any conventional liquid or gaseous cleaning fluid may be employed. The cleaning fluid may also include an additive that will reduce the cohesive bond between the contaminants and the surface being cleaned. The cleaning fluid may include one or more conventional cleaning agents, e.g., surfactants, soft abrasives, hard abrasives and mixtures thereof. In fact, the cleaning fluid may also include anti-foaming agents and the like as desired.

The cleaning fluid may be drawn from a continuous source, e.g., a fire hydrant, or a storage tank, e.g., a conventional tank 94, in which it is readily prepared and stored. Alternatively, the fluid may be recirculated and the dislodged debris removed by conventional filters or other means. The fluid is pumped from the source, e.g., storage tank 94, using a high pressure pump 96 capable of developing as much as 60,000 psi. In operation, it has been found desirable to deliver the fluid at a pressure between about 1,000 psi and about 40,000 psi. At these pressures, water used as the cleaning fluid will exit the nozzles at about 400 ft/sec and about 2,400 ftusec, respectively. Most preferably, the slab cleaner 10 of the present invention is operated with water at a pressure of about 10,000 psi. At this pressure, the water exits the nozzles at a velocity of about 1200 ft/sec. However, in some applications where the cleaning fluid comprises air with entrained particulate abrasives, it may be desirable to operate at a pump pressure as low as about 80 psi. Those skilled in the art will be able to select an appropriate pump pressure to develop the ext velocity required to dislodge the contaminating materials from the surface.

The fluid is delivered from tank 94 to slab cleaner 10 through conventional high pressure lines to cleaning fluid inlet 42 conveniently disposed on handle 50 of slab cleaner 10. Handle 50 is rigidly connected with housing 12 at a pair of diametrically disposed handle mounts 90. Inlet port 42 comprises one port of a three-way connector 44 disposed in handle 50 of slab cleaner 10. Fluid entering handle 50 at connector 44 is directed to nozzles 40 or returned to tank 94 depending upon the position of dump valve 54. With dump valve 54 in the operating position, fluid entering connector 44 is directed through fluid conduit 46, comprising a portion of one arm of handle 50 to elbow 48 connected with cleaning fluid line 30.

The presently most preferred embodiment of slab cleaner 10 includes dump valve 54 for diverting the cleaning fluid from hard surface 100 without requiring that pump 96 be shut down. By releasing handle 56, a less restrictive flow path is created to return cleaning fluid to tank 94. With dump valve 52 in the standby or dump position, fluid entering connector 44 is diverted through hollow hand grip 52, dump valve 54, line 58 and outlet 60 to a hose (not shown) for return to tank 94. Because this flow path will be less restrictive than the path through nozzles 40, most of the fluid entering inlet 42 will be diverted through outlet 60 away from hard surface 100 in the standby position. This convenient feature permits the operator to temporarily halt the cleaning operation without requiring that pump 96 be shut down.

Spent cleaning fluid and dislodged debris are removed from under slab cleaner 10 by entrainment within a high velocity airflow created by applying a vacuum to peripheral chamber 20. Chamber 20 defines at its lower extremity an annular vacuum port 22 disposed about the periphery of inner housing 14. Annular port 22 has a relatively small cross-section through which fluid and debris are withdrawn. The cross-sectional area of annular opening 22 is substantially less than the area subtended by inner housing 14. In fact, to provide the best results, the cross-sectional area of opening 22 should be less than about 10 percent, preferably less than about 5 percent, of the area being cleaned as defined by housing 14.

Figure 5:
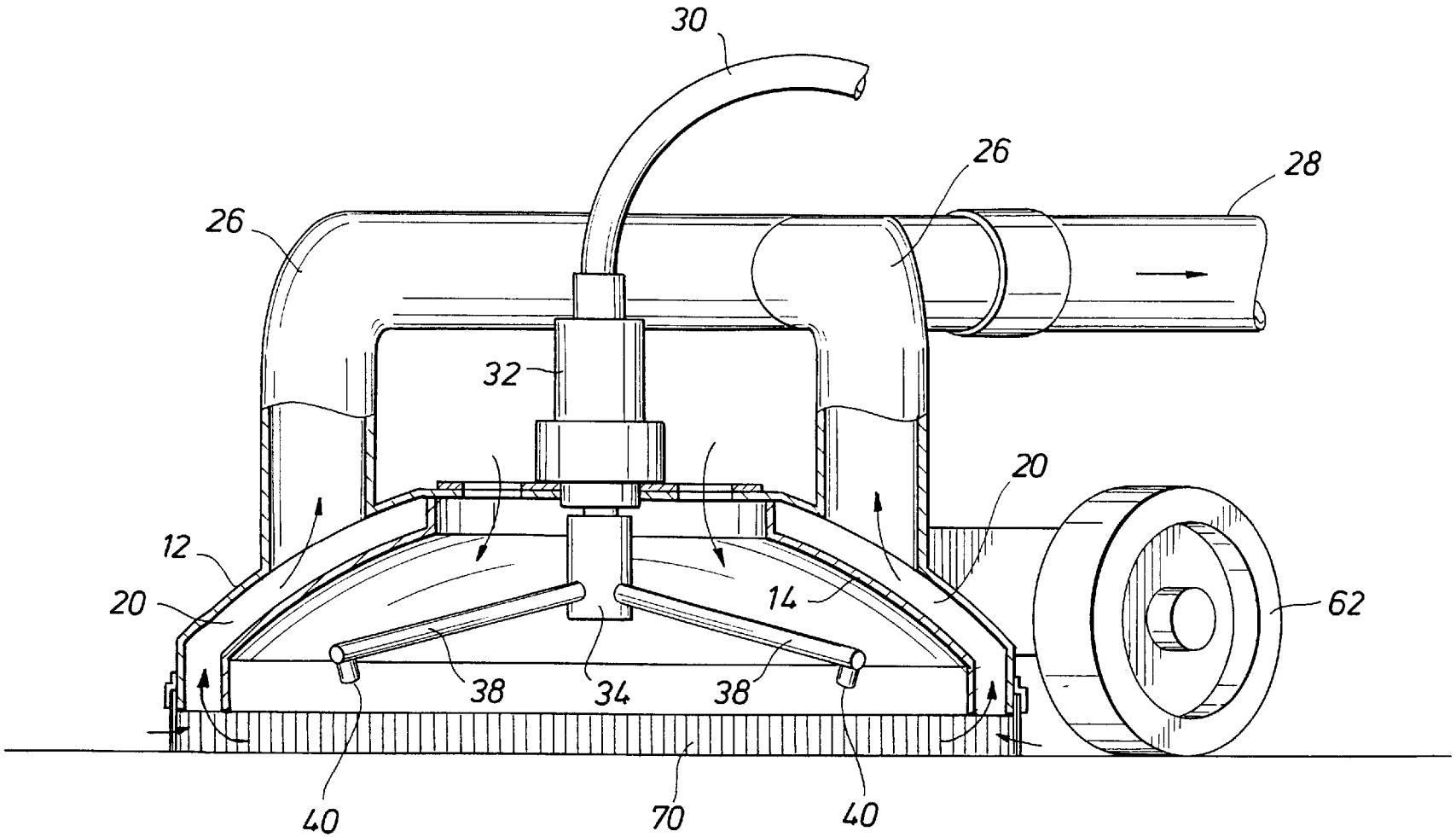
FIG. 5 is a cross-sectional view through line 5—5 of FIG. 2 of a slab cleaning device in accord with the present invention.

The vacuum applied to chamber 20 draws airflow through port 22 both through the interior of housing 14 and from the exterior of housing 12 as illustrated by the arrows in FIGS. 3 and 5. Near the top of chamber 20 are disposed one or more exit ports 24 to which one or more conduits 26 are affixed. Attached to conduits 26 are a flexible suction line 28 in fluid communication with a conventional vacuum source 98 for applying a vacuum to chamber 20. Because the vacuum is applied to a smaller chamber and because the cross-sectional area of port 22 is significantly smaller than that subtended by inner housing 14, high air velocity is developed across hard surface 100 adjacent annular port 22 without fear that slab cleaner 10 will suck down and become temporarily stuck on surface 100. Air velocity at annular port 22 must be sufficient to entrain and remove the spent cleaning fluid and dislodged debris. While air velocity of at least about 75 ft/sec are acceptable for many applications, it is preferred that the velocities be in the range of about 75–200 ftusec. Most preferably the air velocity at port 22 should be about 125–150 ftusec. The high air velocity developed over this smaller surface area also provides improved entrainment and removal of spent cleaning fluid and dislodged debris from under slab cleaner 10.

Slab cleaner 10 also includes one or more vent openings 80 through outer housing 12 directly into the cleaning chamber defined by inner housing 14. Vents 80 permit air to enter the cleaning chamber, thus minimizing the chance that the cleaner 10 will suck down on the surface being cleaned. In a simple embodiment, vent openings 80 are unadjustable. In an alternative, vent openings 80 are covered by an appropriate filter (not shown). In another alternative, slab cleaner 10 of the present invention may include a vent system to permit more precise adjustment of the airflow through inner housing 14. This feature is readily seen in slab cleaner 10 illustrated in FIGS. 2–4. This feature is most easily understood with reference to FIGS. 2 and 4. A pair of fan-shaped diametrically opposed vent openings 80 are placed through outer housing 12 directly into the cleaning chamber defined by inner housing 14. Carried on the exterior surface of outer housing 12 is rotatable adjustment plate 82 characterized by a pair of similarly fan-shaped slots 84 for cooperation with openings 80. By simple rotation of plate 82, slots 84 cooperate with openings 80 to close, open and adjust the size of the air vent through housing 12. Rotatable plate 82 is disposed below tabs 86 which carry adjustment and locking screws 88. When plate 82 has been adjusted to provide the desired vent opening, it may be fixed in place by tightening of screws 88 to frictionally lock it in place.

A flexible skirt 70 is subtended from the lower side of exterior housing 12 to assist in retaining under slab cleaner 10 the cleaning fluid expelled from nozzles 40 and dislodged debris and to reduce the intake of air from outside the housing. Flexible skirt 70 generally extends from the lower side of housing 12 to a plane defined by the lower surface of wheels 62 and 72 in order to be substantially in contact with hard surface 100. However, skirt 70 need not form a seal with hard surface 100 but should be flexible to generally conform therewith in order to reduce the intake of air from outside of housing 12 and to contain the fluid and debris within housing 12.

Those skilled in the art will be aware of convenient methods for maintaining slab cleaner 10 at a substantially fixed distance above surface 100 and providing means for moving slab cleaner 10 across that surface. The simplest means and the one illustrated in the preferred embodiment employs a plurality of wheels disposed on appropriate supports. In the illustrated embodiment, two large rear wheels 62 are disposed at opposite ends of axle 64 carried through a pair of rear axle mounts 66 projecting rearwardly from outer housing 12. FIG. 1 also illustrates handle support strut 68 extending upwardly from the axle mounts 66. Disposed at the front of slab cleaner 10 are one or more front wheels. In the illustrated embodiment, a pair of front wheels 72 are caster mounted from swivel yokes 74 connected to front wheel mounting platforms 76 braced with supporting struts 78. Swivel mounted front wheels 72 permit slab cleaner 10 to be both easily steered and sharply turned.

The foregoing description of the invention has been directed in primary part to a particular preferred embodiment in accordance with the requirements of the Patent Statutes and for purposes of explanation and illustration. It will be apparent, however, to those skilled in the art that many modifications and changes in the specifically described apparatus and methods may be made without departing from the true scope and spirit of the invention. For example, while the manifold, hub, arm and nozzle assembly described provides the preferred means for directing cleaning fluid to the surface to be cleaned, any conventional arrangement which accomplishes this goal may be used. While it is presently preferred to employ the previously described system where the force of the exiting fluid provides the means for rotating the hub, there may be circumstances where it will be desirable to employ a motor to drive the hub, or even to employ a plurality of fixed nozzles in some applications. Therefore, the invention is not restricted to the preferred embodiment described and illustrated but covers all modifications which may fall within the scope of the following claims.

What is claimed is:

1. A portable device for cleaning surfaces, comprising:

a generally dome-shaped housing having an opening on one side for positioning adjacent a hard surface;

a manifold disposed on said housing for communication with a high pressure fluid source;

a rotatable hub within said housing and in fluid communication with said manifold;

a plurality of nozzles disposed on a plurality of symmetrically disposed arms extending from said hub, said nozzles in fluid communication with said hub and positioned to direct exiting fluid toward said surface at a high velocity;

an adjustable air vent through said housing:

a chamber having a port extending about the periphery of said opening in said housing;

means for producing an airflow at said port by applying a reduced pressure to said chamber, said airflow having a velocity sufficient to remove from within said housing fluid and contaminants dislodged from said surface; and means for moving said device along said surface.

2. The device of claim 1 further comprising means for maintaining said housing and chamber at a substantially fixed distance above said surface.

3. The device of claim 2 wherein said means for producing an airflow comprises a remotely located vacuum pump in fluid communication with said chamber and further comprising a tank for receiving and holding said fluid and contaminants removed through said chamber.

4. A portable device for cleaning surfaces, comprising:

a first housing having an opening on one side for positioning adjacent a surface;

a fluid distribution system mounted in said housing for receiving a fluid under pressure and directing said fluid against said surface;

an adjustable air vent through said housing:

a chamber having a port extending about the periphery of said housing and adjacent said opening; and means for producing an airflow at said port, said airflow having a velocity sufficient to remove from within said housing fluid and contaminants dislodged from said surface.

5. The device of claim 4 wherein said chamber is formed between said first housing and a second housing disposed generally concentrically about said periphery of said first housing.

6. The device of claim 4 wherein said means for producing said airflow comprises means for applying a reduced pressure to said chamber.

7. The device of claim 4 wherein said distribution system comprises a fluid passageway through said housing, said passageway in fluid communication with a pressurized fluid source exteriorly of said housing and with a rotatable hub interiorly of said housing.

8. The device of claim 7 further comprising means for rotating said rotatable hub.

9. The device of claim 7 further comprising a plurality of arms symmetrically radiating from said hub, each said arm having at least one nozzle in fluid communication with said hub and positioned at an angle to direct exiting fluid toward said surface so that rotational movement is imparted to said arms and hub by said existing fluid.

10. The device of claim 4 further comprising means for maintaining said device at a substantially fixed distance above said surface.

11. The device of claim 10 further comprising means for moving said device about said surface.

12. The device of claim 10 further comprising a flexible skirt extending between said housing and said surface about the periphery of said housing and exteriorly of said chamber.

* * * * *